United States Patent [19]

Newman

[11] 4,261,493

[45] Apr. 14, 1981

[54] CARRYING AND LOCKING STRAP FOR SKIS AND POLES

[76] Inventor: Marilyn L. Newman, 6842 S. Webster Way, Littleton, Colo. 80123

[21] Appl. No.: 98,127

[22] Filed: Nov. 28, 1979

[51] Int. Cl.[3] ..... E05B 73/00; B65D 71/00

[52] U.S. Cl. ..... 224/257; 280/814; 70/233

[58] Field of Search ..... 224/45 S, 49, 55, 58, 224/917, 202, 257; 70/233, 234, 235, 236; 53/259, 260; 280/11.37 A, 11.37 K, 814

[56] References Cited

U.S. PATENT DOCUMENTS

| | | | |
|---|---|---|---|
| 3,272,526 | 9/1966 | Rumaner | 280/814 |
| 3,590,608 | 7/1971 | Smyth et al. | 280/814 X |
| 3,756,008 | 9/1973 | Smith | 70/233 |
| 3,830,416 | 8/1974 | Smedley | 224/49 X |
| 3,838,585 | 10/1974 | Foote | 280/814 X |
| 4,185,361 | 1/1980 | Stuart | 280/814 X |

*Primary Examiner*—Steven M. Pollard
*Attorney, Agent, or Firm*—Richard D. Law

[57] ABSTRACT

An elongated strap, having metal threads to deter cutting, includes a non-removable ring at one end and a combination lock secured to the other end, for providing an over the shoulder carrier for skis and poles, and a wrap-around lock for securing skis and poles to an anchor.

6 Claims, 4 Drawing Figures

CARRYING AND LOCKING STRAP FOR SKIS AND POLES

This invention relates to combined ski and pole carrying and locking straps.

PRIOR ART

Skis and poles are awkward to carry due to their length, and due to the fact that they are separate items, not easily secured together. These features, also, make the skis and poles difficult to secure, unless a specially designed ski and pole holder-lock arrangement is used. Such arrangements are only found in special locations; ie. some at a ski area, etc. These ski lock systems almost always require the payment of money, most usually by a coin mechanism. Thus, for the temporary storage of skis, the user must pay the full price regardless of the time of storage.

As skiing has expanded, so have the thefts of skis and ski equipment. With the increasing numbers, areas frequented by skiers simply have not kept up the need for securing devices for skis and equipment.

Some attempts have been made to provide devices to aid the skier. For example, U.S. Pat. No. 2,530,695 to Helmert of Nov. 21, 1950, a strap is provided with swivelled, short, buckle strap on each end. This provides a carrying strap, but has no means of locking the skis. A combined wire carrier and ski holding frame is shown in Smedley U.S. Pat. No. 3,830,416 of Aug. 20, 1974. This system does provide a lock means for securing the skis and poles to a ski rack, however, the wire is a very poor carrier, and the unit with the frame is bulky and of a character to be stored in the user's pocket. An elongated strap with Velcro fasteners is shown in Mazzoni, Jr. U.S. Pat. No. 3,960,302 of June 1, 1976, solely as a ski and pole carrier. No means of locking the skis and poles is included in the carrier. A similar strap for solely carrying skis and poles is the device of Knauf U.S. Pat. No. 4,114,838 of Sept. 19, 1978. This unit includes a perpendicular strap secured to both ends of an elongated strap, with the short straps having Velcro fastener halves on each end of the short straps. The short straps wrap around the skis and poles, leaving a carrying loop of the long strap. No locking arrangement is included.

THE PRESENT INVENTION

The present invention provided an elongated strap with an end member on each end for fastening around spaced positions on skis and poles leaving a loop for carrying. One end fastener is a ring for forming a loop around the skis and poles and the other end is a combination lock-ring for forming a loop around the skis and poles at a spaced location, leaving the long strap looped for carrying, as over the shoulder. The strap includes metal threads or cables (woven) to discourage cutting the strap. The end opposite the ring includes an opening ring with a combination lock, opening and closing the ring. This provides means for wrapping the strap around the skis and poles and a pole-like anchor, either horizontal or vertical poles, and locking the skis and poles to the anchor.

OBJECTS AND ADVANTAGES OF THE INVENTION

Included among the objects and advantages of the invention is a ski and pole carrying and locking strap which can be folded to small dimensions for storing in a user's pocket.

Another object of the invention is to provide a strap carrier and lock for skis and poles, having metal reinforcing means to discourage cutting the strap.

Yet another object of the invention is to provide a ski and pole carrying and locking strap which is easy to use for carrying and locking the skis and poles on an anchor.

A further object of the invention is to provide a strap ski and pole carrier and lock which includes a combination lock to provide a complete unit without the need for additional items to make the unit operable.

An additional object of the invention is to provide a simple strap arranged with a non-opening ring at one end and a combination lockable ring at the opposite end providing an effective carrying strap for skis and poles, and a locking, secure unit for such items.

These and other objects and advantages may be readily ascertained by reference to the following description and the appended illustrations.

GENERAL DESCRIPTION OF THE DRAWINGS

DETAILED DESCRIPTION OF THE INVENTION

Figure 1:
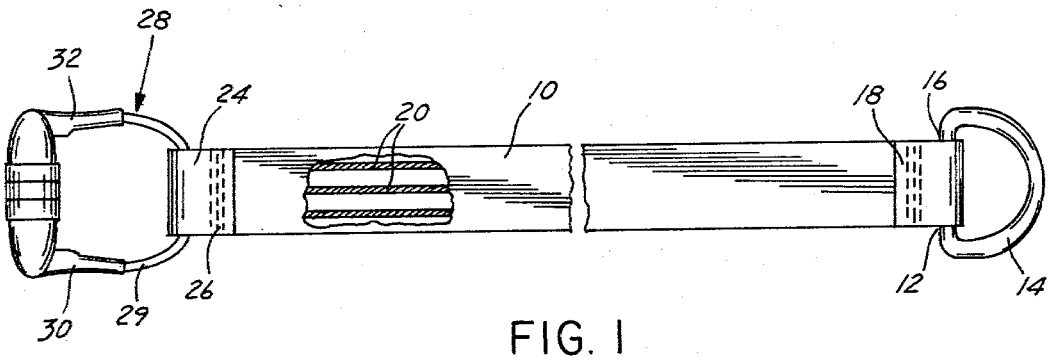
FIG. 1 is a plan view of a strap for carrying and locking skis and poles according to the invention.
Figure 2:
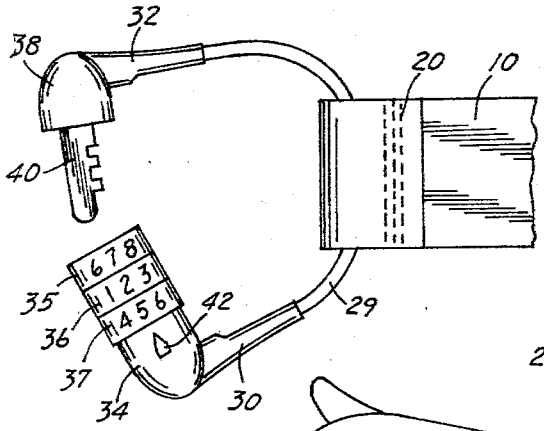
FIG. 2 is detail of the locking end of a strap according to the invention showing the combination lock in open position.

In one form of the invention shown in FIGS. 1 and 2, an elongated strap 10 has one end folded back on itself forming a loop 12 around the straight side 16 of D-ring 14. The loop 12 is secured, in one form, by sewing with metal threads 18. This loop may be secured by other means, as for example rivets or the like. The D-ring is a closed ring, preferably of hardened steel to discourage cutting the ring with bolt cutters, hack saw or the like.

The strap includes multi-strand metal cables 20, similar to aircraft cable, woben into the fabric of the strap. The strap may be formed of woven cloth, plastic or synthetic cords or the like. The metal cables are not easily cut by bolt cutters and, therefore, are preferable. Other types of reinforcing is useful, for example, metal threads which discourages cutting the strap with a knife or scissors, particularly steel threads or bands of hardened, lightweight steel.

The opposite end of the strap 10 is turned back on itself forming loop 24 which is secured in a loop by metal or metalized threads 26. This loop may also be secured by rivets or the like. The loop 24 is sufficiently large to accommodate a ring shown generally by number 28. The ring 28 is preferably formed of a length of aircraft cable 29, providing a flexible ring which is only very difficultly cut. Again, such cables are not normally cut by bolt cutters. One end of the cable includes a fastening end 30 secured to one-half of a combination lock 34. This half includes dial rings 35, 36 and 37, of a three digit combination lock. Of course locks with more or less digits could be used. The other end of the cable 29 includes a fastening 32 secured to the other half of the combination lock 38. This half includes the lock bar 40 which telescopes in the dial (or tumbler) rings 35, 36 and 37 when they are in open position. The bar 40 includes indents as is common in the combination lock art. A pointer 42 indicates the position of the lock's combination, here it is 725, for the tumbler setting.

The strap is maybe about four to six feet long and preferably about five feet long and from about ½ to 1½ inches wide. A satisfactory width is 1 inch. The width is sufficiently wide so as not to cut into the shoulder of the carrier. The length should be sufficient for providing a loop (when attached to skis) for easy carrying.

Figure 3:
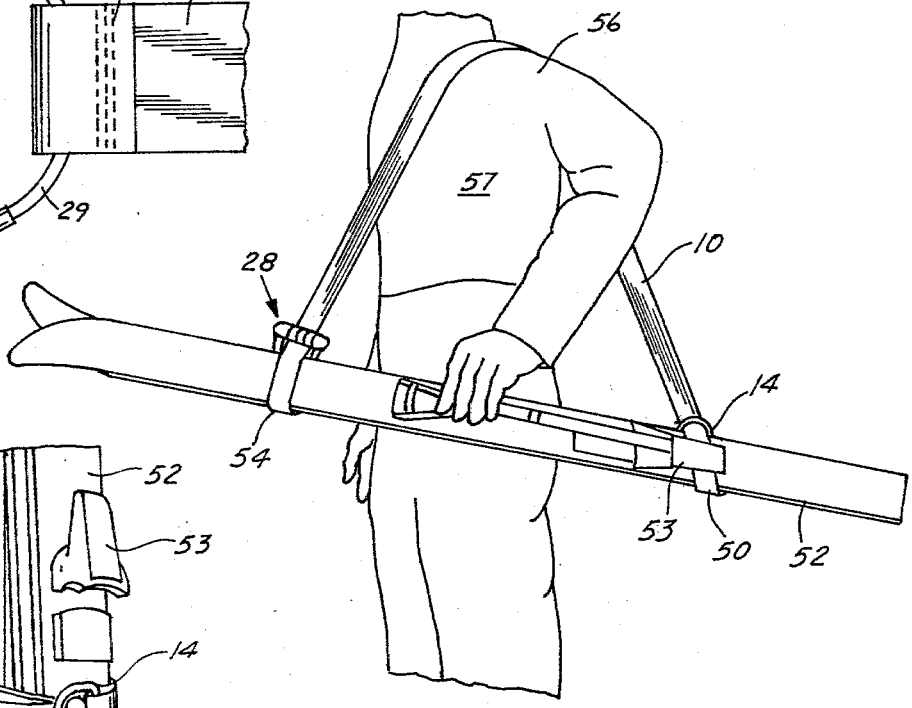
FIG. 3 is a schematic view of the strap of the invention in use on skis and poles as a carrier.

As shown in FIG. 3, the strap 10 is passed through ring 14 forming a loop 50 around a pair of bottom-to-bottom skis 52. The loop is on the ski tail side of bindings 53. The opposite end includes a loop 54 by passing the strap 10 through the ring 28, having the combination lock. This leaves a large loop which may be held on the shoulder 56 of a ski carrier 57, and provides a strap loop carrier mounted with its ends in spaced apart positions on the skis. Ski poles may, also, be carried in the carry set-up, by placing them in the small loops 50 and 54 around the skis. The loops in the end of the strap may be formed by turning the strap through the ring, and the loop may be passed over the ends of the ski. This provides means of mounting the strap on the skis and poles without opening the lock.

Figure 4:
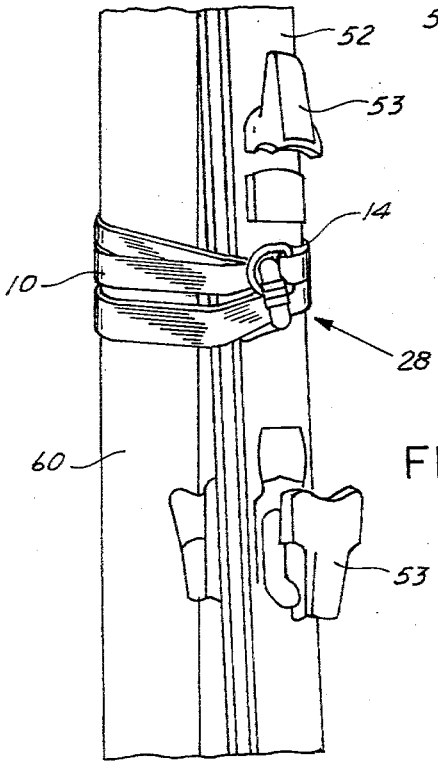
FIG. 4 is a schematic view of a strap of the invention wrapping and locking skis and poles around a vertical anchor.

The strap may be used as a locking device, shown in FIG. 4, where a pair of bottom-to-bottom skis 52 are positioned adjacent a pole 60, normally fastened in place and generally not removable. Normally, both ends of the pole 60 are blinded by attachment to another member, to prevent the secured skis from being slid off the open end of the pole. Also, the pole may be horizontal, as in a fence line. The pole may be wooden, as part of a porch, fence, or other structure, or metal, etc. The skis are secured to the pole 60 by wrapping the strap 10 around the skis and the poles. The combination lock 28 is opened and is passed through the ring 14 and relocked. This secures the skis to the poles. Ski poles may be locked with the skis as by placing them inside the wrapped strap or by passing the strap through the hand loops of the ski poles. The locking of the skis is more secure by tightly wrapping the strap around the skis and the pole between the front and rear binding sections. This prevents the skis from being lifted out of the strap.

When the strap is not in use, it folds up into a small bundle which is not bulky and fits most pockets on ski clothing. This permits the skier to carry the securing and carrying strap for use at locations of stop for rest, eating, etc. The strap is sufficiently long for use around trees, for example, so the lock means provides a very versatile unit for easy carrying and use.

What is claimed is:

1. A carrying and locking strap for skis and ski poles, comprising:

an elongated strap including multistrand metal cable means tending to discourage cutting, said strap being sufficiently long to loop both ends around a pair of skis and provide an over-the-shoulder loop; said strap being sufficiently flexible to be stored in a jacket pocket; said strap being sufficiently wide so as not to cut into the shoulder of the carrier, and sufficiently long to provide a shoulder loop when attached to spaced points on skis;

one end of said strap turned back on itself forming a first loop and securely looped over a closed ring and secured into the loop around said ring;

the opposite end of said strap turned back on itself forming a second loop and having means for securing said end into said second loop; and second ring means inclusive of a ring member and a combination lock secured to the ends of said member passed through said second loop and arranged to lock through said closed ring.

2. A carrying and locking strap according to claim 1 wherein said second ring includes a ring member formed of flexible cable.

3. A carrying and locking strap according to claim 2 wherein said combination lock includes a bar half connected to one end of said flexible cable and a tumbler half connected to the other end of said flexible cable.

4. A carrying and locking strap according to claim 1 wherein said strap is from about four feet to six feet long.

5. A carrying and locking strap according to claim 4 wherein said strap is about five feet long.

6. A carrying and locking strap according to claim 1 wherein said strap is ½ to 1½ inches wide.

* * * * *